United States Patent [19]

Faix

[11] Patent Number: 4,593,602

[45] Date of Patent: Jun. 10, 1986

[54] ROCKET WEAPON SYSTEM AND METHOD THEREFOR

[75] Inventor: John J. Faix, Cocoa, Fla.

[73] Assignee: The United States of America as represented by the Secretary of the Navy, Washington, D.C.

[21] Appl. No.: 678,198

[22] Filed: Dec. 4, 1984

[51] Int. Cl.[4] ..... F41F 3/04

[52] U.S. Cl. ..... 89/1.813; 89/1.816; 102/349; 102/352

[58] Field of Search ..... 89/1.807, 1.813, 1.816; 102/349, 352

[56] References Cited

U.S. PATENT DOCUMENTS

| | | | |
|---|---|---|---|
| 2,517,333 | 8/1950 | Motley | 89/1.7 |
| 3,820,275 | 6/1974 | Green | 102/348 X |
| 3,859,890 | 1/1975 | Guthrie | 89/1.816 |
| 3,999,460 | 12/1976 | Skliris | 89/1.803 |
| 4,038,902 | 8/1977 | Welsh | 89/1.813 X |
| 4,128,039 | 12/1978 | Skliris | 89/1.803 |
| 4,426,910 | 1/1984 | Speer | 89/1.816 |

FOREIGN PATENT DOCUMENTS

| | | | |
|---|---|---|---|
| 511147 | 3/1955 | Canada | 89/1.813 |

*Primary Examiner*—Peter A. Nelson

*Attorney, Agent, or Firm*—R. F. Beers; E. E. Goshorn

[57] ABSTRACT

An improved rifle-actuated rocket weapon system and an improved method for aiming the system in relation to a short range target by firing one or more tracer bullets until it is aimed at the target for launching the rocket weapon. The system is generally made up of a spotting rifle and a rocket weapon launch tube subassembly. The rifle is provided with a magazine for carrying one or more tracer bullets. Fluid passageway means are provided in the launch tube subassembly, rocket weapon fuse device, and rifle. Interconnection of the passageway means with the bullet accelerating and guiding passageway of the rifle is effected by a manually operated normally closed valve. The valve is disposed in the rifle and is operatively associated with the passageway means. When the system is aimed at the target, the valve is opened and a final bullet is fired such that the high temperature, pressurized gases of the bullet are directed via the passageway means to ignite the rocket fuel and arm the rocket weapon fuse device as the weapon is launched to strike the target. The rocket weapon can be positively secured to the launch tube subassembly by a gas-releasable pin that is inserted in the passageway means and that is disposed between the weapon and the subassembly. Since the system is portable and shoulder-held, it is easily maneuverable for progressively aiming the system in relation to a short-range target to be destroyed by a system-launched rocket weapon.

17 Claims, 6 Drawing Figures

ROCKET WEAPON SYSTEM AND METHOD THEREFOR

This invention concerns a rifle-actuated rocket weapon system and a method for aiming the system to launch a rocket weapon and, more particularly, it relates to an improved rifle-actuated rocket weapon launch system and an improved method for progressively aiming the system and finally launching a rocket weapon from the aimed system to strike a short range target.

BACKGROUND OF THE INVENTION

Various weapon launch systems have been designed in the past for striking a short range target. For example, U.S. Pat. No. 3,859,890 to Guthrie concerns a short length tube assembly for launching a rocket-propelled projectile. The assembly is generally made up of a launch tube and a relatively movable projectile ejection tube. The ejection tube is provided with a rocket motor and a projectile. Upon firing the motor, the ejection tube advances out of the launch tube so as to extend the ballistics of the assembly in firing the projectile. U.S. Pat. No. 2,517,333 to Motley discloses a rocket weapon launch device. The device is generally made up of a launch tube having a magazine at its exhaust end. The tube is also provided with a hand grip for enabling actuation of a combined firing and magazine feeding mechanism. Two U.S. Pat. Nos. 3,999,460 to Skliris and 4,128,039, also to Skliris, relate to rocket weapon launch devices of similar design. Each device is shoulder held and is provided with a rotatable magazine that can be readily loaded in the field. A double trigger mechanism is provided for each device for not only launching a rocket weapon, but also to rotate the magazine so that the next-to-be-launched rocket weapon is aligned with the barrel of either device. U.S. Pat. No. 4,426,910 to Speer concerns a shoulder-fired and portable rocket weapon launch system. The system is in its folded, carrying configuration when not used. The system is generally made up of forward and rear hingedly interconnected launch tube sections. The forward section includes a dependent hand grip for assisting in aiming the system prior to actuation of the electric firing mechanism. The rear section is reloadable with a rocket weapon after each firing of the system. Both launch tube sections are provided with extendable blast shields. However, none of the teachings of the aforediscussed patents, whether taken singly or in any combination, remotely suggest an improved shoulder-held, rifle-actuated rocket weapon launch system for impacting a short range target having, among other things, a simplified trigger mechanism for not only firing one or more tracer bullets to progressively aim the system at a target, but also after finally aiming the system at the target another bullet is fired for effecting launch of the rocket weapon.

SUMMARY OF THE INVENTION

An object of the invention is to provide an improved portable rifle-actuated rocket weapon launch system that includes a target spotting rifle for firing one or more tracer bullets at a short range target so as to finally aim the system at the target prior to launching the rocket weapon.

Another object of the invention is to provide an improved portable rifle-actuated rocket weapon launch system that is preloaded with both the rocket weapon and a series of tracer bullets so that it is immediately useable.

Still another object of the invention is to provide an improved rifle-actuated rocket weapon launch system that includes an automatically releasable lock for positively retaining the rocket weapon until it is launched.

Yet another object of the invention is to provide an improved rifle-actuated rocket weapon launch system that includes a selectively interconnectable passageway for directing high temperature, pressurized gases from a fired tracer bullet to launch a rocket weapon at a target.

Yet still another object of the invention is to provide an improved rifle-actuated rocket weapon launch system that includes a mechanical trigger arrangement for firing one or more tracer bullets and for launching a rocket weapon.

A summary of the invention is an improved shoulder-held, rifle-actuated rocket weapon launch system. The system is generally made up of a target spotting rifle and a launch tube subassembly removably affixed thereto. The rifle is generally comprised of an appropriate trigger actuated firing mechanism, a magazine for storing one or more tracer bullets and a barrel having a passageway for accelerating and guiding a bullet from the rifle when fired. The magazine is interposed between the firing mechanism and the barrel. The tube subassembly is generally made up of a launch tube for receiving a rocket weapon and a housing disposed about the tube. The tube housing and rifle include cooperative means for effecting attachment of the subassembly to the rifle. The exhaust end of the tube includes a rocket fuel igniter for insertion in the exhaust nozzle of the rocket weapon. Interconnectable passageways are provided in the subassembly and rifle for effecting fluid communication between the barrel passageway and the igniter and between the barrel passageway and the fuse device of the rocket weapon, A valve is mounted in the rifle for normally closing off communication between the barrel passageway and the interconnecting passageways. A selectively and manually operable valve actuating mechanism is mounted in the rifle for actuating the valve from a closed to an open position. Prior to assembly of the subassembly to the rifle, a releasable yet frictionally retained pin can be inserted in the passageway between the rocket weapon fuse arm device and the tube housing so that the rocket weapon is positively retained in the tube prior to launch. Once a target is sighted by the user to be destroyed by the improved system the user initially aims the pistol toward the target and then fires one or more tracer bullets at the target for the purpose of progressively and finally aiming the system at the target. Then, the valve actuating means is actuated for opening the valve and another bullet is fired. The high temperature, pressurized powder gases of the fired bullet are directed from the barrel passageway through the interconnecting passageways to actuate the igniter for igniting the rocket fuel, advance the pin to unlock the rocket weapon and arm the fuse device as the rocket weapon is launched from the aimed system to strike the target.

DETAILED DESCRIPTION OF THE INVENTION

Figure 1:
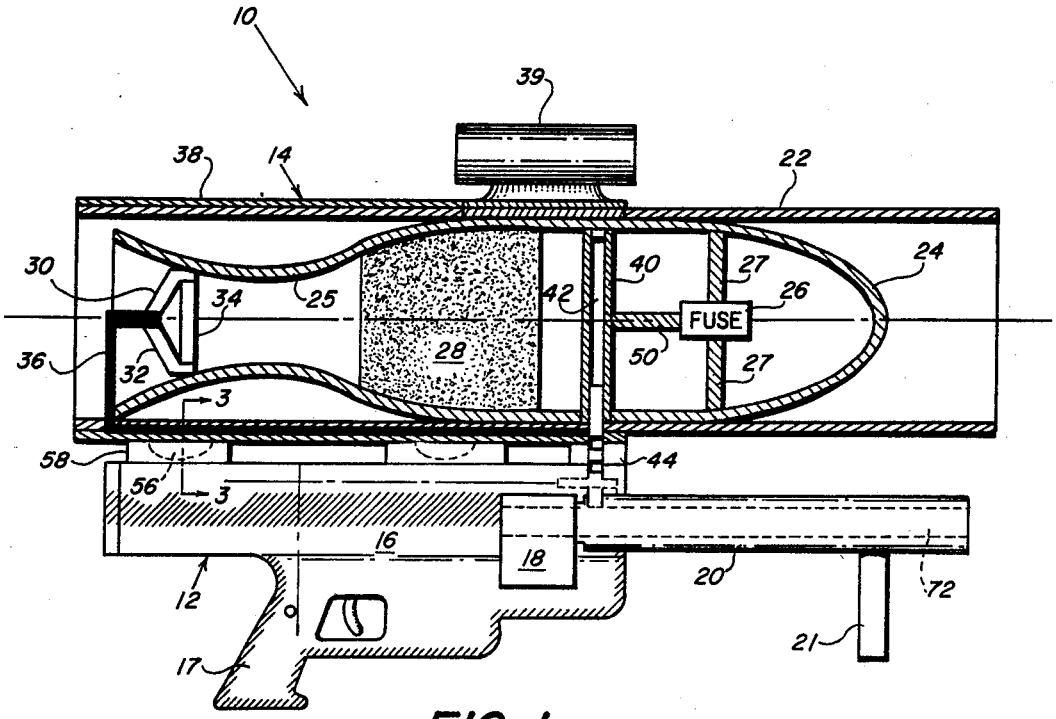
FIG. 1 is a combined elevational and longitudinal sectional view of an embodiment of the invention.
Figure 2:
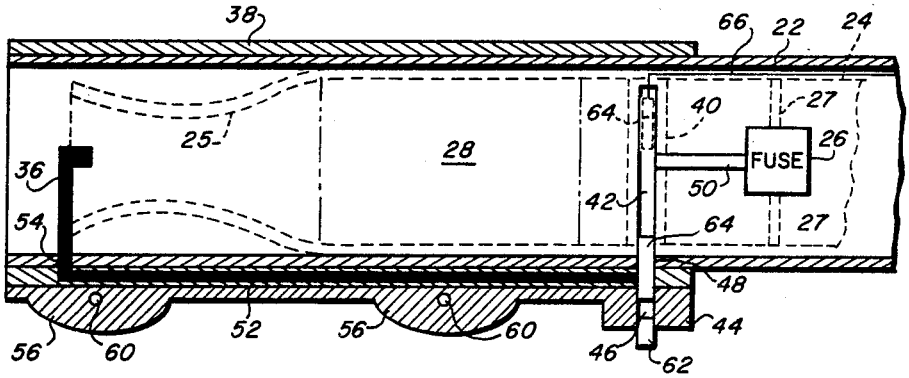
FIG. 2 is an enlarged longitudinal sectional view of the rocket weapon launch tube subassembly of the invention with parts removed and other parts broken away.

With further reference to FIG. 1 of the drawings, an improved shoulder-held, rifle-actuated rocket weapon system 10 for impacting a short range target is generally made up of a rifle 12 and a launch tube subassembly 14. The rifle is generally comprised of a housing 16 with a hand grip 17, a rotary magazine 18, and a barrel 20. The forward end of the barrel at the lower end thereof is provided with another hand grip 21 for assisting the user in aiming and stabilizing system 10 during its use. The launch tube subassembly is provided with a recoilless launch tube 22 for receiving a rocket weapon 24 having an exhaust nozzle 25. For the sake of brevity only certain details of weapon 24 in relation to the invention are shown in FIGS. 1-2. The weapon includes a fuse arming device 26 and a mass of appropriate solid rocket fuel 28. Bridging elements 27 connect device 26 to the outer housing of weapon 24 and maintain the device in alignment with a longitudinal axis thereof. A rocket fuel igniter device 30 is inserted in the exhaust nozzle of weapon 24. The device is provided with a funnel-shaped enclosure 32, the enlarged end of which is closed off by a solid mass 34 of suitable ignitable material of circular disc-shaped configuration for igniting rocket fuel 28 of the weapon during system use. An inverted L-shaped tube 36 extends between the inner end of tube 22 and the apex end of housing 32. As will become more apparent hereinafter, tube 36 not only supports igniter 30 in concentric relation to nozzle 25 of weapon 24, but the tube passageway also directs high-temperature, pressurized gases toward and in contact with ignitable mass 34 for igniting same so as to cause ignition of rocket fuel 28.

As best shown in FIG. 2, a support housing 38 is disposed about tube 22 at its exhaust end. The upper portion of housing 38 at the forward end thereof is provided with a suitable optic device 39 for assisting in sighting and aiming system 10 at a target during system use. Intermediate bridging section 40 of weapon 24 is provided with a radial passageway 42. The forward lower end of housing 38 is provided with a depending protrusion 44. Tube 22 and protrusion 44 are provided with interconnecting radial passageways 46 and 48 that are alignable and in direct open communication with passageway 42. An axially extending tube 50 extends between fuse device 26 and bridging section 40, and is connected thereto. As will become more apparent hereinafter, tube 50 provides an interconnecting fluid passageway between passageway 42 and device 26. An axially extending passageway 52 is formed in the lower portion of housing 38 and extends between a tube radial passageway 54 and housing radial passageway 46 and is connected thereto. Tube radial passageway 54 is aligned with tube 36 such that the passageway of tube 36 is in direct open fluid communication with housing passageways 46 and 52.

Figure 3:
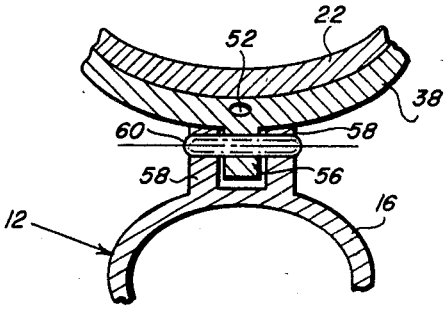
FIG. 3 is an enlarged and fragmented cross-sectional view taken along line 3—3 of FIG. 1.

The lower part of housing 38 is provided with a pair of longitudinally spaced lugs 56. As best shown in FIG. 3, rifle housing 16 includes a pair of upstanding U-shaped brackets that are longitudinally spaced relative to each other in similar fashion as the pair of depending lugs 56 of housing 38. Each one of the brackets 58 of the pair thereof is adapted to receive its associated lug 56 when assembling each bracket 58 to its associated lug 56. Each assembled bracket and lug is provided with alignable apertures for receiving a pin 60 in order that housing 38 is secured to rifle housing 16 as shown in FIG. 1. The lower end of protrusion 44 is provided with a tube extension 62 of passageway 46 that facilitates connection to the passageway of barrel 20 as will be more fully apparent hereinafter.

A rocket weapon locking pin 64 is inserted in passageway 46 prior to affixing tube 62. Pin 64 is of such a length that it extends between the lower end of passageway 42 and the upper end of passageway 46 as best shown in FIG. 2. The pin is of such a diameter that it is loosely yet frictionally retained between passageways 42 and 46 despite normal handling of system 10 so that weapon 24 remains in tube 22 until it is launched. As will become more apparent hereinafter, when high-temperature, pressurized gases are admitted to passageway 46 during system use, pin will be advanced to the upper end of passageway 42 beyond passageway 50 so as to unlock weapon 24 from tube 22 as shown by dotted lines in FIG. 2. The upper end of passageway 42 is provided with an appropriate venting arrangement to the atmosphere as diagrammatically indicated at 66 in FIG. 2 so as to facilitate the advancement of pin 64 to the upper end of passageway 42. It is to be understood that frictionally retained pin 64 is one suitable means for locking weapon 24 to tube 22 and that other suitable means can be used, e.g., a spring biased pin with a locking pawl arrangement.

Housing 16 of rifle 12 is preferably comprised of two half sections **16*a* and 16*b* of die cast construction. Both half sections of the housing are readily joined together in appropriate fashion. One of the pistol housing sections 16*a* is partially shown in FIG. 4 with various internal mechanisms assembled thereto as will now be described. Since both housing sections 16*a* and 16*b* are substantially similar only one housing section 16*a*** will be described in detail unless otherwise specified hereinafter.

Figure 4:
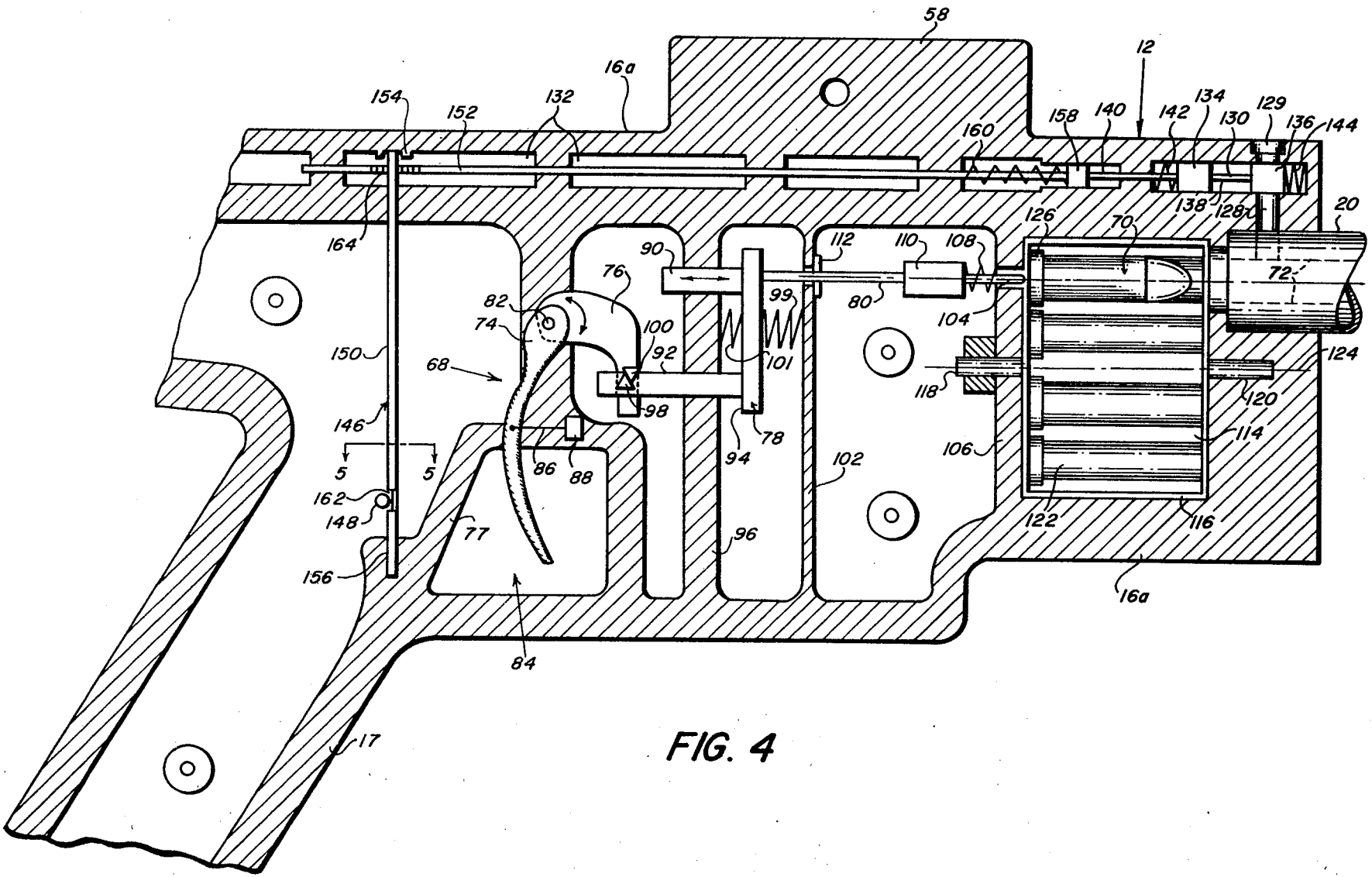
FIG. 4 is an enlarged longitudinal view of one of the housing sections of the rifle subassembly of the invention with parts added and other parts broken away.

Housing section **16*a* includes a finger controlled trigger mechanism 68 for firing one or more tracer bullets 70 through the bullet accelerating and guiding passageway 72 of barrel 20. Mechanism 68 is generally made up of a finger-actuated and spring biased pawl 74, actuating pawl 76, spring biased cam follower linkage 78, and spring biased firing pin 80. Pawls 74 and 76 are separately secured to a common shaft 82, the ends of which are suitably journaled in housing sections 16*a* and 16*b*. Further, the ends of shaft are connected to an intermediate bridging portion 77 of housing section 16*a* that forms part of a finger-receiving aperture 84. The lower end of pawl 74 extends into aperture 84 as depicted in FIG. 4. A spring 86 extends between pawl 74 and boss 88 for biasing pawl to a reset position for firing a bullet 70**.

Cam follower linkage 78 is provided with two parallel spaced rod portions 90 and 92 of different length that extend from the same side of an interconnecting bar element 94. Each rod portion 90 or 92 is journably mounted in another intermediate bridging section 96 of housing section 16*a*. The outer end of rod 92 includes a triangular shaped cam 98. The lower end of pawl 76 is also provided with an overlapping and engaging triangular-shaped cam 100. A coil spring 99 is interposed between bar 94 and a third intermediate bridging section 102 of housing section 16*a*. A coil spring 101 extends between briding section 96 and bar 94. The relative strengths of springs 99 and 101 are such together with the slopes of engaging surfaces of cams 98 and 100 that cams 98 and 100 as the result of biasing action of springs 99 and 101 will always return to the reset position as depicted in FIG. 4 after each movement of pawl 74 for actuating firing pin 80 during operation of system 10.

Firing pin 80 passes through an aperture of third intermediate bridging section 102 and extends between bar 94 and aperture 104 of fourth bridging section 106. A spring 108 extends between section 106 and an enlarged portion 110 of pin and urges pin to a retracted position while at the same time it maintains pin in engagement with the upper end of bar 94. A washer 112 is affixed about an intermediate portion of pin 80 for limiting the biased retractive movement of pin 80 and its pressured contact with bar 94, A rotatably indexable magazine 114 is mounted in the aperture 116 of housing section 16*a* between bridging section 106 and the outer end of the housing section in the manner illustrated in FIG. 4. Opposed ends of the magazine are provided with stub shafts 118 and 120 that are journably mounted in housing section 16*a*. Magazine 114 about its outer periphery is provided with a series of eight equally spaced longitudinally extending openings 122 (only four of which are shown in FIG. 4) that are concentrically disposed about magazine axis 124. Each opening 122 has a diameter substantially corresponding to the diameter of barrel passageway 72 and the cartridge portion of bullet 70. The left end of each opening 122 as viewed in FIG. 4 is enlarged or countersunk so as to receive and retain the flattened enlarged head portion 126 at the cartridge end of bullet 70. After the firing of each tracer bullet 70 aligned with firing pin 80 and barrel passageway 72, magazine 114 can be rotatably indexed by the user to the next position so that the next bullet to be fired is aligned with barrel passageway 72. The ratchet mechanism for indexing the magazine from one position to the next for aligning the next bullet to be fired through barrel passageway 72 is not shown for the sake of brevity.

The forward end of rifle housing 16*a* at the upper part thereof includes a passageway 128 the lower end of which is in direct open fluid communication with the inner end of barrel passageway 72 as depicted in FIG. 4. The upper end of passageway 128 is enlarged or countersunk at 129 for receiving the lower end of tube 62 of housing 38 when subassembly 14 is connected to the top of rifle 12 in the manner aforedescribed.

A valve 130 is provided in pistol housing 16*a* and is operatively associated with passageway 128 for normally closing off passageway 128 between its ends; and thus normally closing off open fluid intercommunication between barrel passageway 72 and subassembly passageways 36, 42, 46, 48, 50, 52 and 54.

The upper part of rifle housing section 16*a* is provided with a series of axially aligned and interconnected bores 132, only four of which are shown as illustrated in FIG. 4. Valve 130 is provided with a pair of axially aligned and relatively spaced plungers 134 and 136 that are interconnected by stem 138. A pilot stem 140 is connected to plunger 134 and is of such a length that it extends into the next leftwardmost bore of the series of bores 132. A spring 142 is interposed between plunger 134 and the adjacent left end of the rightwardmost bore as viewed in FIG. 4. Similarly, a spring 144 is interposed between plunger 136 and the adjacent right end of the rightwardmost bore. The relative strengths of springs 142 and 144 are such that valve 130 is biased to an intermediate position for normally closing off passageway 128.

Figure 5:
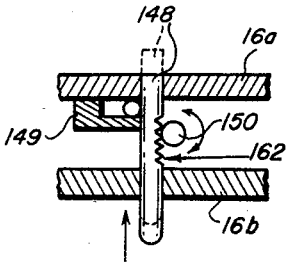
FIG. 5 is an enlarged transverse sectional view taken along line 5—5 of FIG. 4 with parts added, and it illustrates in dotted and solid lines more than one operative position.

A manually operable valve actuating assembly 146 is provided and operatively associated with valve 130. The assembly is generally comprised of a series of three interconnecting rods 148, 150 and 152. Shortest length rod 148 extends transversely of and between pistol housing sections 16*a* and 16*b* and is slidably connected thereto as best shown in FIG. 5. Rod 148 is located adjacent to finger receiving opening 84. A detent mechanism 149 is mounted on the inside surface of housing section 16*a* for maintaining rod 148 in its initial preset position such that the flat end of rod is in planar alignment with the outer surface of housing section 16*a*. Intermediate rod 150 extends vertically between the top and bottom of housing section 16*a* as illustrated in FIG. 4. The upper and lower ends of rod 150 are journably connected to rifle housing section 16*a* as indicated at 154 and 156 in FIG. 4. Longest rod 152 extends horizontally between five intermediate bores 132 of the series of bores 132 at the top of housing section 16*a*. The right end of rod 152 as viewed in FIG. 4 includes an enlarged portion 158 which is slidably disposed in the reduced right end of bore 132 that is arranged adjacent to the righthandmost bore 132. Rod end portion 158 abuts the outer end of valve stem 140. A spring 160 is disposed about rod 152 and is interposed between portion 158 and the left end of the associated bore 152 so as to maintain rod 152 in abutting contract with valve stem 140. Rods 148 and 150 at their area of overlapment are provided with appropriate rack and pinion gearing as generally indicated at 162 and best shown in FIG. 5 so that rod 148 is interconnected to rod 150. Similarly rods 150 and 152 at their area of overlapment as best shown in FIG. 4 are provided with appropriate rack and pinion gearing as generally indicated at 164 so that rods 150 and 152 are interconnected. In view of the foregoing when the user of system 10 axially advances rod 148 from its initial outward solid line position to its inner dotted line position this advancement is transmitted by rack and pinion arrangement 162 to rod 150 by rotating same clockwise as viewed in FIG. 5. This rotation of rod 150 is transmitted by rack and pinion arrangement 164 to rod 152 by axially advancing same from left to right in FIG. 4. Rightward movement of rod 152 urges valve 130 from left to right so that valve plunger 144 no longer closes off passageway 128 between its ends.

Figure 6:
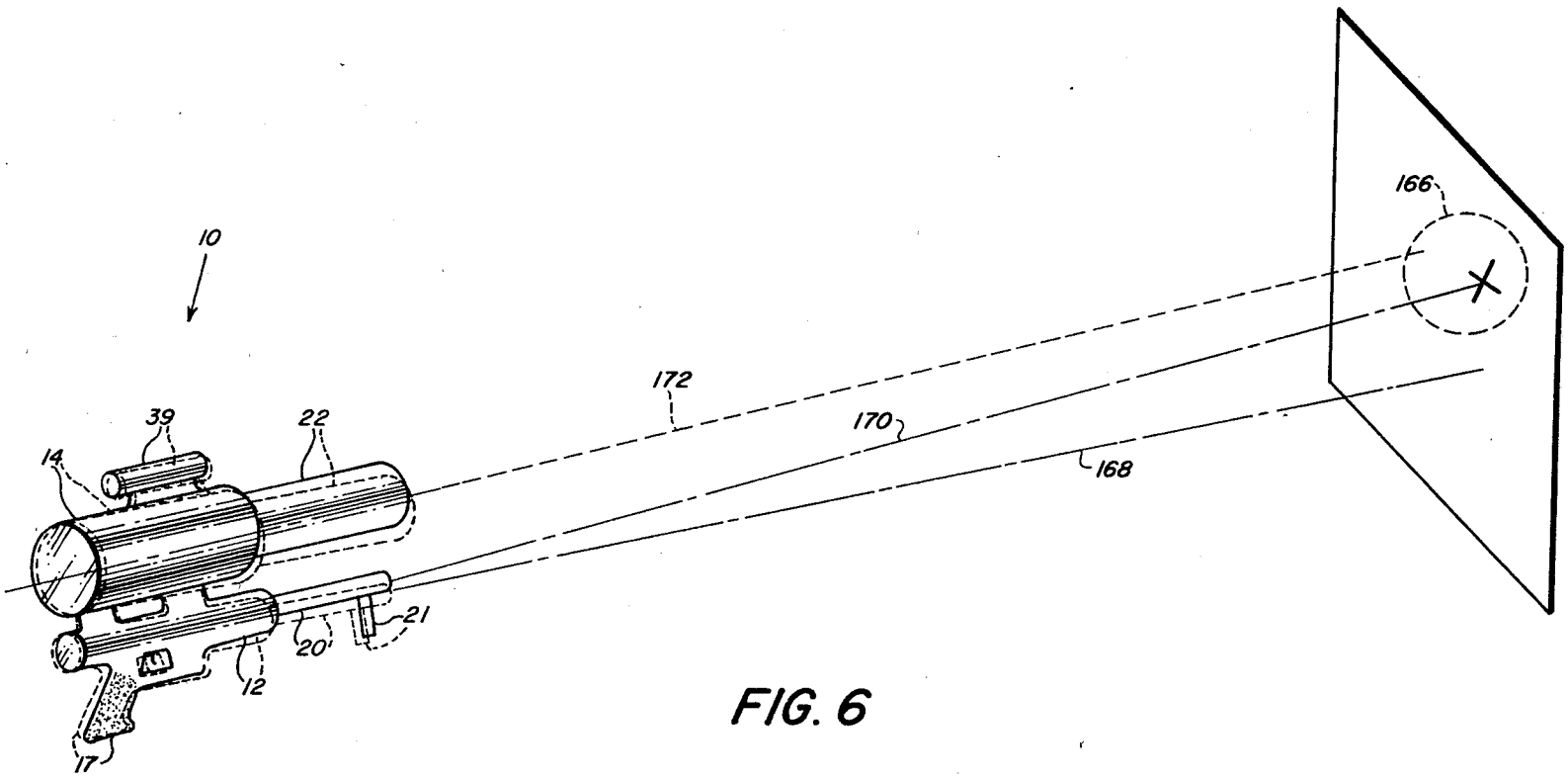
FIG. 6 is a diagrammatic view of the invention and illustrates in dotted and solid lines more than one aiming and firing mode in relation to a target prior to launching the rocket weapon from the system.

In an operative embodiment of system 10 the user intends to quickly aim and strike a short range target, within circle 166, as depicted in FIG. 6. One suitable position in aiming and firing system 10 is that the user lie in the prone position with the exhaust end of tube 22 over the user shoulder while the user hands appropriately grip elements 17 and 21. With the magazine of system preloaded with a series of thirty (30) caliber bullets 70 and with tube 22 preloaded with an eighty-three millimeter (83 mm) rocket weapon 24, the user with the assistance of sighting device 39 generally aims system 10 in the direction of target 166 and fires a first tracer bullet along tracer designated path 168 that, e.g., was offset down and away from the target. After magazine 114 is indexed to advance the next bullet to be fired through passageway 72, the user with the assistance of sight device 39 together with path 168 reaims system 10 toward target 166 and and refires trigger mechanism 68 so as to cause the fired tracer bullet to advance along path 170 that strikes target 166. By virtue of system 10 being of relatively light weight construction and by virtue of the user being able to use both hand grips 17 and 21 the user can maintain the aim of system along path 170. At the same time the user without adversely affecting the aim of system 10 along path 170 not only rotatably advances magazine 114 to align another bullet 70 to be fired but also axially advances rod 148 to its inner position so as to open valve 130 and passageway 128 as aforedescribed. After pushing rod 148, the user reactuates trigger mechanism 68 so as to fire another bullet. Because of opened passageway 128 the exploding high temperature, pressurized powder gases from the cartridge of the fired bullet are directed through passageway 128 and then through passageway 46 to advance pin to the upper end of passageway 42 to release weapon 24 for launch. At the same time these gases are simultaneously admitted through passageways 46, 42 and 50 to effect arming of fuse device in a known manner and then through passageways 52, 54 and 36 to ignite igniter material 34. Ignition of material causes ignition of solid fuel rocket propellant 28 thereby launching weapon 24 along path 172 toward the target and destroying same.

It is known that firing of a bullet causes the ignited black powder thereof to generate a gas having a pressure on the order of from about eight thousand pounds per square inch (8K psi) to about thirty thousand pounds per square inch (30K psi) while at the same time the pressurized gas generates a high temperature from about eighteen hundred degrees Fahrenheit (1,800° F.) to about twenty four hundred degrees Fahrenheit (2,400° F.). The black powder of a bullet 70, when fired, which generates a gas with the aforementioned range of pressure and temperature is sufficient to release, arm, and launch weapon 24 in the manner aforedescribed. By virtue of sight device 39 together with rapid repetitive firing of one or more tracer bullets 70 at a short range target 166 on the order of about two hundred fifty meters (250 m) away, the system is quickly aimable and effective for destroying the target with an 83 mm weapon 24.

Obviously many modifications and variations of the present invention are possible in light of the above teachings. It is therefore to be understood that, within the scope of the appended claims, the invention may be practiced otherwise than as specifically described.

What is claimed is:

1. The method of aiming and firing a rifle-actuated rocket weapon system for destroying a target, the system being generally made up of a rifle and a rocket weapon launcher mounted thereon, the method comprising the steps of:

generally aiming the rifle of the system toward a target, selectively firing one or more tracer bullets after the rifle is generally aimed such that the rifle is reaimed toward the target in relation to the tracer-designated path of the previously fired bullet until a tracer bullet impacts the target thereby indicating the system is finally aimed for firing the rocket weapon thereof, providing selectively interconnectable fluid passageway means for interconnecting the bullet accelerating and guiding passageway of the rifle with the rocket motor igniter of the rocket weapon within the launcher, and firing another tracer bullet after finally aiming the system while at the same time interconnecting the passageway means with the bullet accelerating and guiding passageway so that the high-temperature, pressurized gases generated by the powder of the bullet fired within the bullet accelerating and guiding passageway of the rifle are directed towards and through the passageway means for igniting the rocket motor so as to cause launching of the rocket weapon from the aimed system to impact the target.

2. The method of aiming and firing a rifle-actuated rocket weapon system for destroying a target, the system being generally made up of a rifle and a rocket weapon launcher mounted thereon, the method comprising the steps of:

generally aiming the rifle of the system toward a target, selectively firing one or more tracer bullets after the rifle is generally aimed such that the rifle is reaimed toward the target in relation to the tracer-designated path of the previously fired bullet until a tracer bullet impacts the target thereby indicating the system is finally aimed for firing the rocket weapon thereof, providing selectively interconnectable fluid passageway means for interconnecting the bullet accelerating and guiding passageway of the rifle with the rocket motor igniter of the rocket weapon within the launcher and also with the fuse means thereof, and firing another tracer bullet after finally aiming the system while at the same time interconnecting the passageway means with the bullet accelerating and guiding passageway so that the high-temperature pressurized gases generated by the powder of the bullet fired within the bullet accelerating and guiding passageway of the rifle are directed towards and through the passageway means for simultaneously igniting the rocket motor and arming the fuse means of the rocket weapon so as to cause launching of the rocket weapon from the aimed system to impact the target.

3. The method of claim 2 wherein the step of firing one or more tracer bullets is effected by a rifle having a selectively indexable rotary magazine for carrying one or more tracer bullets and for aligning each bullet to be fired with a bullet accelerating and guiding passageway of the rifle.

4. The method of claim 2 wherein the step of providing selectively interconnectable fluid passageway means is effected by the rifle having a normally closed valve and manually operable rod actuating means connected to the valve for actuating same from a closed to an open position.

5. A pistol-actuated rocket weapon system for aiming and selectively launching a rocket weapon therefrom, said system comprising:

rifle means and rocket weapon launching means mounted thereon, said launching means being made up of a launch tube and tube support housing means, said tube having a rocket weapon inserted therein and rocket motor igniter means affixed to said tube at the exhaust end thereof for insertion in the exhaust nozzle of the rocket weapon, said igniter means being disposed adjacent and exposed to the ignitable fuel of the rocket motor within said weapon, said igniter means having first fluid passageway means for effecting ignition of said igniter means, the first passageway means having an inlet port in direct open communication with the exterior of the tube;

said tube support housing means having a second fluid passageway means with inlet and outlet ports, said housing means being affixed to said tube at the exhaust end thereof, such that the outlet port of the second passageway means is aligned with the inlet port of the first passageway means, said rifle means being comprised of rifle housing means having depending hand-grip mcans for enabling user support of both the launching means and the rifle means when aiming and selectively firing the rifle and launching means during system use; said rifle housing means being made up of barrel means affixed to its outer end, the barrel means having a passageway between its ends for accelerating and guiding a bullet, magazine means provided on said rifle housing means for carrying one or more tracer bullets and for advancing each tracer bullet of the series of bullets into alignment with the bullet accelerating and guiding passageway of the barrel means, said rifle housing means having upstanding means, said upstanding means being provided with third fluid passageway means, the inlet part of the third fluid passgeway means being in direct open communication with the bullet accelerating and guiding passageway of the barrel means at a point forward of a tracer bullet when the magazine aligns the bullet with the inner end of the bullet accelerating and guiding passageway, means for coupling together said upstanding means and said tube support housing means such that the outlet port of said third passageway means is in direct open communication with the inlet port of the second passageway means, said rifle housing means being provided with a finger-actuatable fire control mechanism, said mechanism including a firing pin for striking a tracer bullet when the magazine aligns the bullet with the inner end of the barrel means as the magazine is actuated by the user during system use, said upstanding means including valve means interposed between and connected to the third passageway means between the inlet and outlet ports thereof; said valve means including means for biasing the valve means to a closed position, and valve actuating means mounted in said rifle housing means, said valve actuating means being connected to said valve means and being selectively operable to open said valve means for effecting fluid communication between the first, second, and third passageway means, the firing pin of said fire control mechanism being actuated to strike a bullet in the magazine in alignment with the inner end of the bullet guiding passageway of said barrel means so as to ignite the powder in the bullet to form high temperature, pressurized gases in the bullet guiding passageway, when said rifle means is finally aimed toward the target; the bullet guiding passageway of the barrel means directing the gases from the passageway through both the open valve means and the first through third passageway means for igniting the motor fuel of the rocket weapon so that the rocket weapon is launched from the aimed system to strike the target.

6. A rocket weapon system as set forth in claim 5 wherein said valve actuating means is comprised of a pair of axially movable rod means, and rotatable rod means, said rotatable rod means being interposed between said pair of rod means, each of said pair of rod means and said rotatable rod means being provided with rack and gear means for interconnecting each of said pair of rod means to said rotatable rod means.

7. A rocket weapon system as set forth in claim 5 wherein said tube support housing means includes a pair of longitudinally spaced depending lug means for facilitating attachment to said rifle housing means, wherein said rifle housing means is provided with a second pair of upstanding longitudinally spaced lug means, the second pair of upstanding lug means being alignable with the first pair of lug means; and wherein means are provided for interconnecting the first and second pairs of lug means so that the launching means is mounted on and secured to said rifle housing means.

8. A rocket weapon as set forth in claim 7 wherein said upstanding means is disposed longitudinally forward of the second pair of lug means.

9. A rifle-actuated rocket weapon system for aiming and selectively launching a rocket weapon therefrom, said system comprising:

rifle means and rocket weapon launching means mounted thereon, said launching means being made up of a launch tube and tube support housing means, said tube having a rocket weapon inserted therein and rocket motor igniter means affixed to said tube at the exhaust end thereof for insertion in the exhaust nozzle of the rocket weapon, said igniter means being disposed adjacent and exposed to the ignitable fuel of the rocket motor within said weapon, the rocket weapon being provided with fuse means, said igniter means and said fuse means having first and second fluid passageway means for effecting ignition of said igniter means and for effecting arming of said fuse means, the first and second passageway means being spaced from each other and being arranged to have inlet ports in direct open communication with the exterior of the tube;

said tube support housing means having a third fluid passageway means with an inlet port and a pair of spaced outlet ports and with the inlet and outlet ports being in fluid intercommunication with each other, said housing means being affixed to said tube at the exhaust end thereof; such that one of the outlet ports of the third passageway means is aligned with the inlet port of the first passageway means while the other one of the outlet ports of the third passageway means is aligned with the inlet port of the second passageway means, said rifle means being comprised of rifle housing means, said rifle housing means being made up of barrel means affixed to its outer end, the barrel means having a passageway between its ends for accelerating and guiding a bullet therethrough.

said rifle means including magazine means for carrying one or more tracer bullets and for advancing each tracer bullet of the magazine means into alignment with the bullet accelerating and guiding passageway of the barrel means at its inner end, said rifle housing means having upstanding means, the upstanding means being provided with fourth fluid passageway means, the inlet port of the fourth fluid passageway means being in direct open communication with the bullet guiding passageway of the barrel means at a point forward of a tracer bullet when the magazine aligns the bullet with the inner end of the bullet guiding passageway, means for coupling together said upstanding means and said support housing means such that the outlet port of said fourth passageway means is in direct open communication with the inlet port of the third passageway means, said rifle housing means being provided with a finger-actuatable fire control mechanism, said mechanism including a firing pin for striking a tracer bullet when the magazine aligns the bullet with the inner end of the barrel means as the mechanism is actuated by the user during system use, said upstanding means including valve means connected to the fourth passageway means and interposed between the inlet and outlet ports thereof; said valve means including means for biasing the valve means to a closed position, and selectively operable valve actuating means mounted in said rifle housing means, said valve actuating means being connected to said valve means and being selectively operable to open said valve means for effecting fluid communication between the first, second, third and fourth passageway means; the firing pin of said fire control mechanism being actuated to strike a bullet in the magazine in alignment with the inner end of the bullet guiding passageway of said barrel means so as to ignite the powder in the bullet to form high temperature, pressurized gases in the bullet guiding passageway, when said rifle means is finally aimed toward the target, the bullet guiding passageway of the barrel means directing the gases from the passageway through the open valve means and the first through fourth passageway means for igniting the motor fuel of the rocket weapon while at the same time arming said fuse means so that the rocket weapon is launched from the aimed system to strike the target.

10. A rocket weapon system as set forth in claim 9 wherein said tube support housing means includes a pair of longitudinally spaced depending lug means for facilitating attachment to said rifle housing means, wherein said rifle housing means is provided with a second pair of upstanding longitudinally spaced lug means, the second pair of upstanding lug means being alignable with the first pair of lug means; and therein means are provided for interconnecting the first and second pairs of lug means so that the launching means is mounted on and secured to said rifle housing means.

11. A rocket weapon as set forth in claim 10 wherein said upstanding means is disposed longitudinally forward of the second pair of lug means.

12. A rocket weapon system as set forth in claim 9 wherein said rifle housing means and said barrel means have depending hand-grip means, the hand-grip means for assisting in supporting, aiming, and firing the system during use.

13. A rifle-actuated rocket weapon system for aiming and selectively launching a rocket weapon therefrom, said system comprising:

rifle means and rocket weapon launching means mounted thereon, said launching means being made up of a launch tube and tube support housing means, said tube having a rocket weapon inserted therein and rocket motor igniter means affixed to said tube at the exhaust end thereof for insertion in the exhaust nozzle of the rocket weapon, said igniter means being disposed adjacent and exposed to the ignitable fuel of the rocket motor within said weapon, the rocket weapon being provided with fuse means, said igniter means having first fluid passageway means for effecting ignition of said igniter means, said fuse means having second and third passageway means, the first and second passageway means being spaced from each other and being arranged to have inlet ports in direct open communication with the exterior of the tube, the inner end of the third passageway means intersecting the second passageway means at an intermediate point thereof, the outer end of the third passageway means being connected directly to said fuse means, said tube support housing means having a fourth fluid passageway means with an inlet port and a pair of spaced outlet ports and with the inlet and outlet ports being in fluid intercommunication with each other, said housing means being affixed to said tube at the exhaust end thereof such that one of the outlet ports of the fourth passageway means is aligned with the inlet port of the first passageway means while the other one of the outlet ports of the fourth passageway means is aligned with the inlet port of the second passageway means, said rifle means being comprised of rifle housing means, said rifle housing means being made up of barrel means affixed to its outer end, the barrel means having a passageway between its ends for accelerating and guiding a bullet therethrough, said rifle means including magazine means for carrying one or more tracer bullets and for advancing each tracer bullet into alignment with the bullet accelerating and guiding passageway of the barrel means, said rifle housing means having upstanding means, said upstanding means being provided with fifth fluid passageway means, the inlet port of the fifth fluid passageway means being in direct open communication with the bullet accelerating and guiding passageway of the barrel means at a point forward of a tracer bullet when the magazine aligns the bullet with the bullet accelerating and guiding passageway, means for coupling together said upstanding means and said support housing means such that the outlet port of said fifth passageway means is in direct open communication with the inlet port of the fourth passageway means, pin means disposed in both the second and fourth passageway means and extending between the inlet and outlet ports thereof, said pin means for retaining the rocket weapon in the launch tube prior to firing the rocket weapon, said rifle housing means being provided with a finger-actuatable fire control mechanism, said mechanism including a firing pin for striking a tracer bullet when the magazine aligns the bullet with the inner end of the barrel means as the mechanism is actuated by the user during system use, said upstanding means including valve means interposed between and connected to the fifth passageway means between the inlet and outlet ports thereof; said valve means including means for biasing the valve means to a closed position, and selectively operable valve actuating means mounted in said rifle housing means, said valve actuating means being connected to said valve means and being selectively operable to open said valve means, the firing pin of said fire control mechanism being actuated to strike a bullet in the magazine in alignment with the inner end of the bullet accelerating and guiding passageway of said barrel means so as to ignite the powder in the bullet to form high temperature, pressurized gases in the bullet guiding passageway, when said rifle means is finally aimed toward the target; the bullet guiding passageway of the barrel means directing the gases from the passageway through both the open valve means and the fifth passageway means such that the pin means is advanced from the outlet port of the fourth passageway means through the inlet port of the second passageway means to beyond the intersection with the third passageway means while at the same time the gases are in direct open communication with the first through fourth passageway means for igniting the fuel of the rocket weapon as well as arming said fuse means so that the rocket weapon is launched from the aimed system to strike the target.

14. A system as set forth in claim 13 wherein the second passageway means has an outer end beyond the intersection with the third passageway means, and wherein the outer end includes means for venting the outer end to the atmosphere.

15. A rocket weapon system as set forth in claim 13 wherein said tube support housing means includes a pair of longitudinally spaced depending lug means for facilitating attachment to said rifle housing means, wherein said rifle housing means is provided with a second pair of upstanding longitudinally spaced lug means, the second pair of upstanding lug means being alignable with the first pair of lug means; and wherein means are provided for interconnecting the first and second pairs of lug means so that the launching means is mounted on and secured to said rifle housing means.

16. A rocket weapon as set forth in claim 15 wherein said upstanding means is disposed longitudinally forward of the second pair of lug means.

17. A rocket weapon system as set forth in claim 13 wherein said rifle housing means and said barrel means have depending hand-grip means, the hand-grip means for assisting in supporting, aiming, and firing the system during use.

* * * * *